US006219873B1

(12) United States Patent
Keuchel

(10) Patent No.: US 6,219,873 B1
(45) Date of Patent: Apr. 24, 2001

(54) DEVICE FOR CLEANING SHOE SOLES

(76) Inventor: Bernhard Keuchel, Franz-Werfel-Weg-8, D-41469 Neuss (DE)

( * ) Notice: Subject to any disclaimer, the term of this patent is extended or adjusted under 35 U.S.C. 154(b) by 0 days.

(21) Appl. No.: 09/193,244

(22) Filed: Nov. 17, 1998

(30) Foreign Application Priority Data

Nov. 19, 1997 (DE) ..... 197 51 049

(51) Int. Cl.[7] ..... A47L 23/26
(52) U.S. Cl. ..... 15/161; 15/217; 15/238
(58) Field of Search ..... 15/161, 215, 216, 15/217, 237, 238, 239, 240, 241

(56) References Cited

U.S. PATENT DOCUMENTS

| | | | | |
|---|---|---|---|---|
| 852,955 | * | 5/1907 | Houghton | 15/161 |
| 3,064,296 | * | 11/1962 | Lidke | 15/161 |
| 3,663,980 | * | 5/1972 | Conklin | 15/215 |
| 4,313,238 | | 2/1982 | Harbin . | |
| 5,996,160 | * | 12/1999 | Pruitt | 15/217 |

FOREIGN PATENT DOCUMENTS

| | | | | |
|---|---|---|---|---|
| 170220 | | 4/1955 | (DE) . | |
| 1628771 | | 1/1971 | (DE) . | |
| 2811094A1 | | 9/1979 | (DE) . | |
| 2835736 | * | 3/1980 | (DE) | 15/215 |
| 4119986 | * | 12/1992 | (DE) | 15/161 |
| 40 6-169876 | * | 6/1994 | (JP) | 15/215 |

* cited by examiner

*Primary Examiner*—Terrence R. Till
(74) *Attorney, Agent, or Firm*—Nash & Titus, LLC

(57) ABSTRACT

A device (1) for cleaning shoe soles with at least one cleaning element (2) and at least one base element (3) as support for the shoe sole, whereby the shoe sole can be cleaned/cleansed by a relative motion carried out with direct effect between the shoe sole and the cleaning element. In addition, the invention relates to a method for cleaning shoe soles, in particular with the help of the device mentioned in the beginning, whereby the shoe sole is placed on a base element (3) and the shoe sole is cleaned/cleansed by a relative motion carried out with direct effect between the shoe sole and a cleaning element (2). The cleaning effect on shoe soles is increased in that—in the case of the device—base element (3) is designed movably to create the relative motion between the shoe sole and the cleaning element (2) and/or—in the case of the method—the base element (3) is moved to create the relative motion between the shoe sole and the cleaning element (2).

27 Claims, 6 Drawing Sheets

DEVICE FOR CLEANING SHOE SOLES

BACKGROUND OF THE INVENTION

1. FIELD OF THE INVENTION

The invention relates to a device for cleaning show soles with at least one cleaning element and at least one base element as support for the shoe sole, whereby the shoe sole can be cleaned/cleansed by a relative motion carried out with direct effect between the shoe sole and the cleaning element. In addition, the invention relates to a method for cleaning shoe soles, whereby the shoe sole is placed on a base element and is cleaned/cleansed by a relative motion carried out with direct effect between the shoe soles and a cleaning element.

2. DESCRIPTION OF RELATED ART

Various devices for cleaning shoe soles/shoes are known in the state of the art.

On the one hand, shoe scrapers/door mats are very common in the state of the art. The typically known shoe scrapers/door mats are situated in front of the entry area of a house or apartment door on the ground and usually have a rough surface. Grooves, bumps or bristles are usually provided on the surface, so the user can accordingly clean his shoe soles with the help of the shoe scraper/door mat before he enters the house or apartment area. For this, the user brushes with the shoe on his foot, namely with the shoe sole, over the surface of the shoe scraper/door mat, whereby a relative motion effective directly between the shoe sole and the cleaning element is then created between the surface of the door mat, which can be generally designated as a cleaning element, and the shoe sole. In this way, the dirt particles clinging to the shoe sole are detached from the shoe sole by the cleaning element and remain on the surface of the shoe scraper/door mat, namely usually remaining sticking to the cleaning element. To increase the cleaning effect of a shoe scraper/door mat, it is also known that the shoe scraper/door mat is coated with a corresponding protective layer e.g. with a moistened absorber, to ensure with the moistened absorber, for example, that larger quantities of dirt particles clinging to the shoe soles are picked up by the cleaning element/by the coat.

On the other hand, in the state of the art devices for cleaning shoes are known, referred to as automatic shoe-cleaners, that are usually very common in hotels. These automatic shoe-cleaners often located in the hallways of hotels have, in the bottom area, a usually roundly designed, pivoted cleaning element. If the user, in particular the hotel guest, then wishes to clean/cleanse his shoes, he starts the automatic shoe-cleaner accordingly, in such a way that the cleaning element designed as a type of roller rotates at a certain speed. The user can then clean the surfaces of his shoes by bringing the corresponding shoe into contact with the rotating cleaning element, in such a way that due to the relative motion carried out with direct effect between the surfaces of the shoes and the cleaning element, namely the rotation of the cleaning element, the dirt particles clinging to the surface of the shoes are removed. Although the automatic shoe-cleaners mentioned here are not intended for the users to clean the shoe soles of their shoes but rather only the surface of the shoes, practical experience has shown that particularly hotel guests tend to also clean the shoe soles of their shoes using the automatic shoe cleaners described here.

In the state of the art on which the invention is based, devices for cleaning shoes are known that have several cleaning elements, designed as continuous belts, with bristles, whereby the cleaning elements are motor-driven in a base element or run around a base element. These devices have a certain, limited width and are usually arranged in front of businesses or stores in the entry area. The customer entering the store/business walks over the base element which is fixed in position, whereby, during the brief walking on the base element/the support of the shoe sole on the base element, the elongated designed, motor-driven cleaning elements clean the customer's shoe sole/shoe soles before he enters the store/the business.

The devices known in the state of the art for cleaning shoe soles are not designed optimally. Practical experience has shown that even if the user tries to carefully clean his shoe soles—larger dirt particles remain clinging to the shoe soles, whereby the corresponding house or apartment area is soiled in the end, because dirt particles clinging to the shoe soles often detach from the shoe soles only later. These problems are in particular attributable to the fact that a user standing on the shoe scraper/door mat can always clean only the shoe soles of one shoe, namely by first shifting his body weight almost completely onto one foot and thus onto one shoe sole and trying to move the other shoe sole less loaded by body weight back and forth and/or to accordingly brush it over the shoe scraper/door mat. So that the other shoe sole of the two shoes can be cleaned shortly thereafter, there takes place a corresponding shifting of the user's body weight onto the shoe sole already cleaned, at least in the heel, whereby he then carries out the same motion with the shoe sole yet to be cleaned. Practical experience has shown that in particular due to the low body weight load on the shoe sole to be cleaned, the relative motion carried out with direct effect between the shoe sole and the cleaning element is often not sufficient to remove all dirt particles clinging to the shoe sole. In particular, due to the low body weight load/the pressure by load on the shoe sole to be cleaned, no sufficient friction is present between the shoe sole and the cleaning element, in such a way that the cleaning effect is not optimal. Furthermore, when brushing a shoe sole on a shoe scraper it is problematic that the user brushes the feet in longitudinal direction although the profile—with crosswise grooves—of the shoe soles would be better cleaned by brushing the shoe soles in crosswise direction. Yet a brushing of the shoe soles in crosswise direction is not carried out by the user, in particular because this represents an unusual and uncomfortable motion for him/for his foot.

The cleaning effect of the devices known in the state of the art, which have a stationary base element and motor-driven cleaning elements designed as continuous belts, is not optimal either. On the one hand, the user walks on the base element only very briefly and tries—as practical experience has shown—to quickly enter the store/business in the entrances of which such devices are provided. Users regard such devices with a certain "skepticism". Because they at first notice the motor-driven cleaning elements designed as continuous belts. The users sometimes feel inhibited from walking on these devices, which is naturally understandable, because one does not wish to walk on a moving element, in order to run the risk of losing his balance and falling. It has even already occurred that users try to circumvent or to step over as quickly as possible such devices, i.e., the cleaning elements moving before their eyes, in order to have "solid ground" under their feet again as soon as possible. For these reasons, the period of time in which the users' shoe soles touch the motor-driven cleaning elements is relatively brief, in such a way that the cleaning effect is no optimal due to the brief contact time of the cleaning elements with the shoe soles.

The invention is therefore based on the technical problem of designing and further developing the known device for cleaning shoe soles/the known method for cleaning shoe soles in such a way that the cleaning effect on the shoe soles is increased.

SUMMARY OF THE INVENTION

The aforementioned technical problem is now solved for the device in that the base element is designed movable to create the relative motion between the shoe sole and the cleaning element.

For the method, the aforementioned technical problem is solved in that the base element is moved to create the relative motion between the shoe sole and the cleaning element.

The invention is based on the principle that the relative motion with direct effect between the shoe sole and the cleaning element is not carried out in that the shoe/the shoe sole must be moved, namely must be moved back and forth over the cleaning element, or —as in the state of the art—the cleaning element, designed as continuous belt, is itself motor-driven, but rather that the shoe/the shoe sole can be placed onto a base element and the relative motion between the shoe sole and a cleaning element provided is created by movement of the base element, without the shoe/the shoe sole itself having to be moved over the cleaning element/over the base element (base surface). This has the advantage that the user namely does not have to slightly lift the shoe sole to be cleaned nor tend—as in the state of the art—to walk quickly over the device in order for the shoe sole to be cleaned, but rather the user can more effectively put pressure on the shoe sole/shoe soles with the body weight available to him. In this way, a corresponding friction is provided between the shoe sole and the cleaning element during the relative motion directly effective between the shoe sole and the friction element. This avoids the above-described disadvantages, namely it increases the cleaning effect on the shoe soles to be cleaned.

There are numerous possibilities for designing and further developing advantageous manner the invention's device for cleaning shoe soles/the invention's method for cleaning shoe soles. In addition, a preferred example of execution of the device according to the invention will now be described in more detail with the help of drawings. The drawings show:

DETAILED DESCRIPTION OF THE INVENTION

Figure 1:
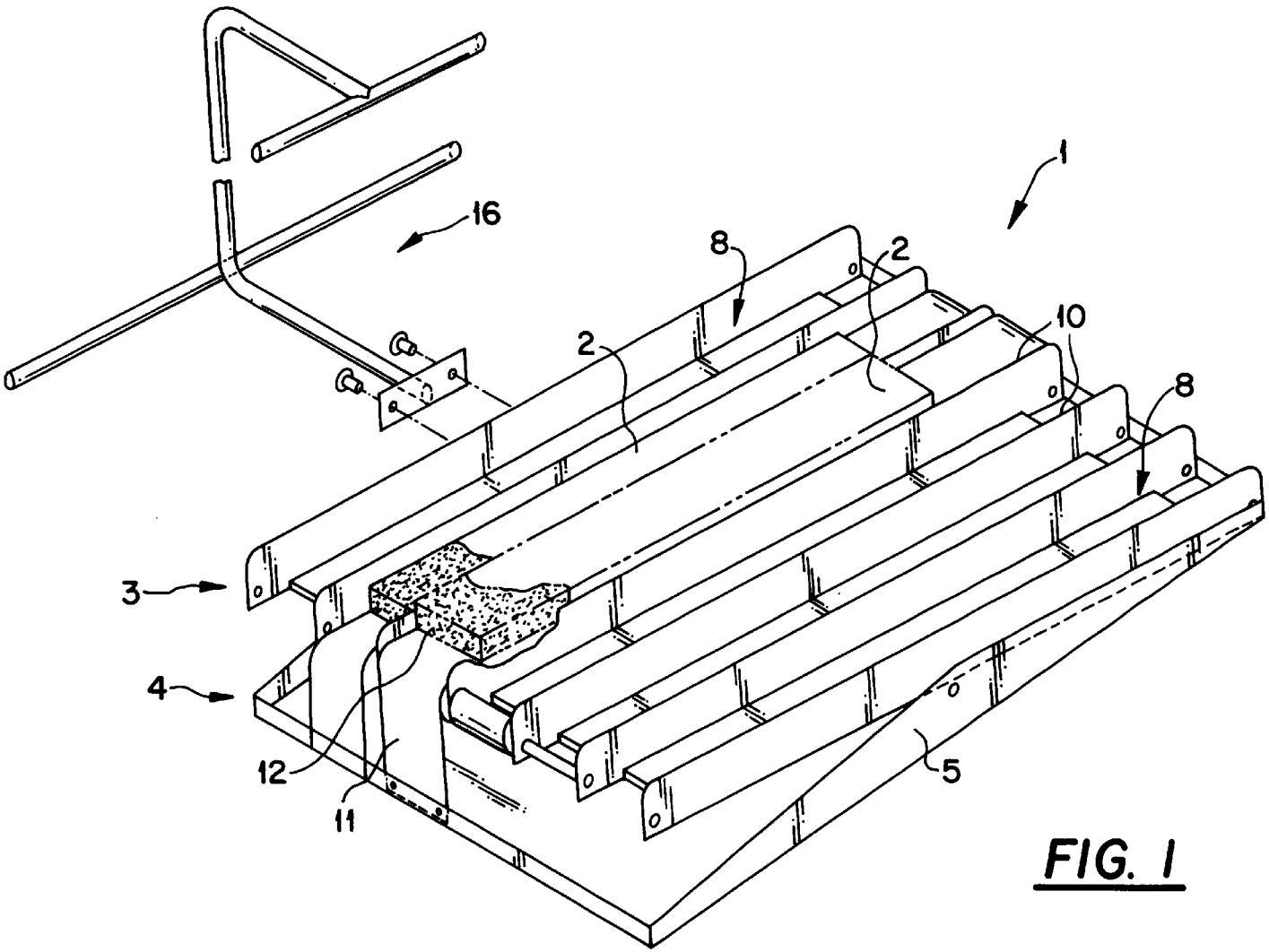
FIG. 1 the preferred example of execution of the device according to the invention in a diagrammatic view in perspective, with a holding device shown additionally in the upper left edge, FIG. 1*a* a diagrammatic view, in perspective, according to another embodiment of the invention, FIG. 2 the frame of the device shown in FIG. 1 in a diagrammatic front view, FIG. 3 the frame of the device shown in FIG. 2 in a diagrammatic side view, FIG. 4 the frame f the device shown in FIG. 2 in a diagrammatic top view, FIG. 5 the base element of the device shown in FIG. 1 without the cleaning elements, in a diagrammatic front view, FIG. 6 the base element from FIG. 5 in a diagrammatic side view, FIG. 7 the base element from FIG. 5 in a diagrammatic top view, FIG. 8 a cleaning element in a diagrammatic top view, FIG. 9 a cleaning element with a number of bristles indicated, in a diagrammatic side view, FIG. 10 the holding device indicated in FIG. 1 in the upper left, in a diagrammatic side view, FIG. 11 the holding device from FIG. 10 from behind, FIG. 12 the holding device from FIG. 10 in top view.
Figure 1A:
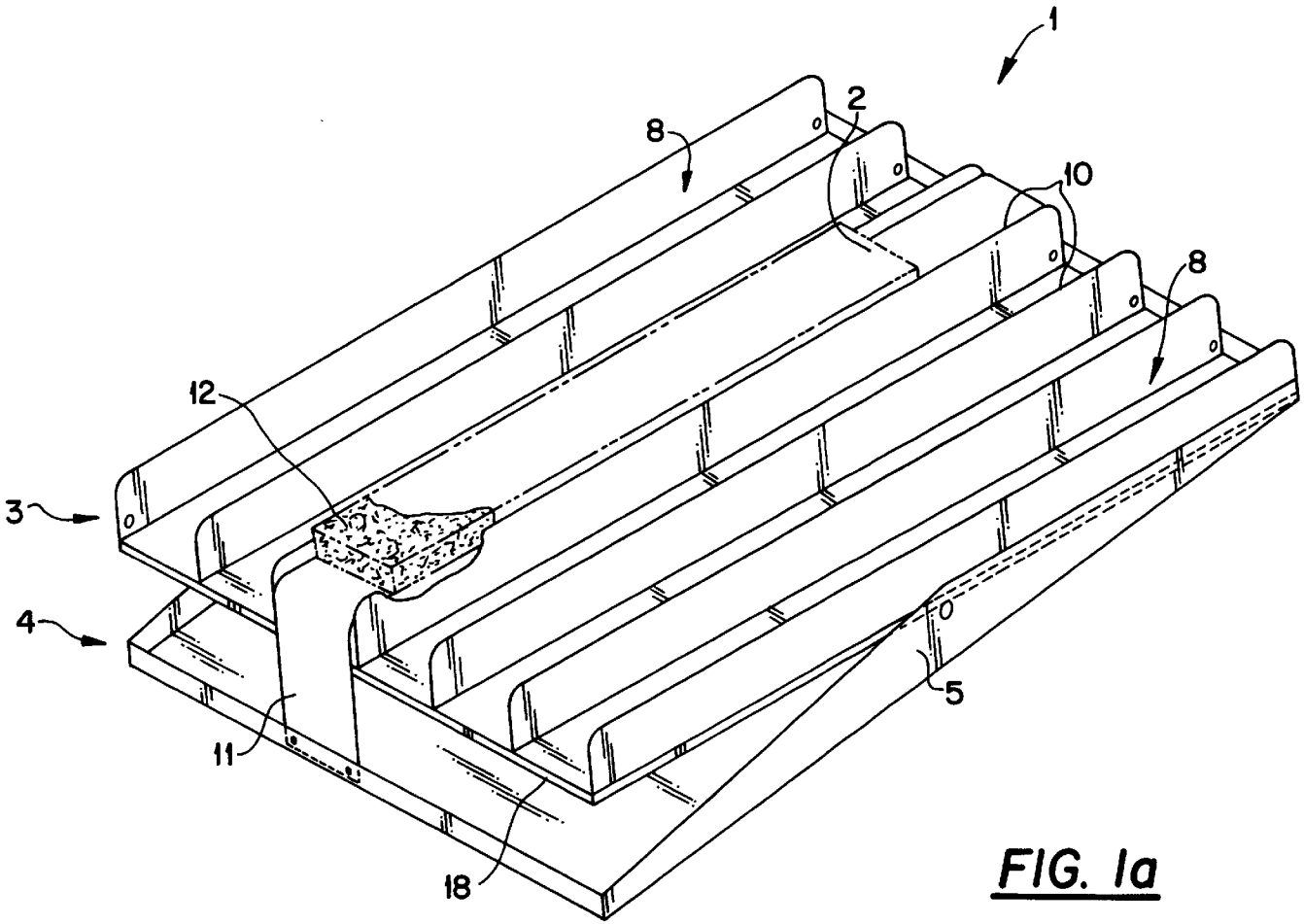

FIG. 1 shows in a perspective diagrammatic view a device 1 for cleaning shoe soles with several cleaning elements, though only two cleaning elements 2 shown here and a base element 3 as support for the shoe sole. The shoe sole can be cleaned/cleansed by a relative motion carried out with direct effect between a shoe sole and the cleaning element 2.

The disadvantages described in the beginning are avoided in that a base element 3 is provided as support for the shoe sole/the shoe soles, which is designed movable to create the relative motion between the shoe sole and the cleaning element 2. In particular, it is advantageous that a user can stand on the base element 3 provided for this and the relative motion between the shoe sole and the cleaning element 2 is produced by the movement of the base element 3, i.e., the shoe soles can remain on the base element 3 in their original position without the shoe soles having to be moved over the base element 3 nor the cleaning elements 2—as in the state of the art—being designed as continuous belts and themselves having to be driven accordingly.

FIG. 1 shows that the base element 3 is arranged inside a frame 4, namely it is mounted movably in the mid-region of the frame 4.

Figure 2:
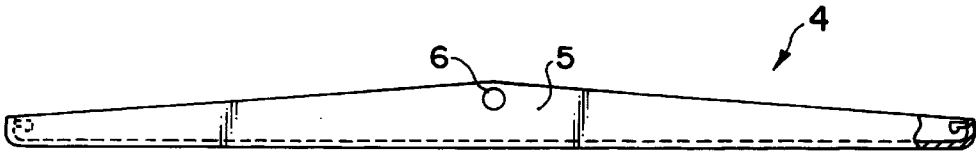

FIG. 2 shows that the frame 4 is designed as a kind of trough, and has a middle area with a raised edge 5.

Figure 3:
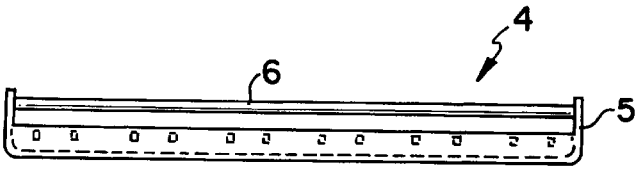
Figure 4:
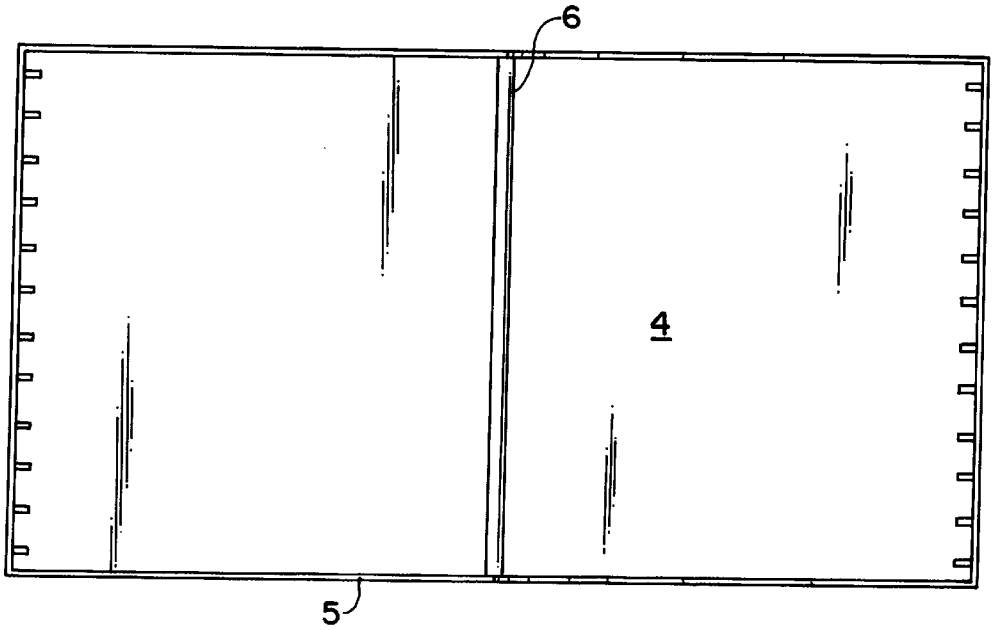
Figure 7:
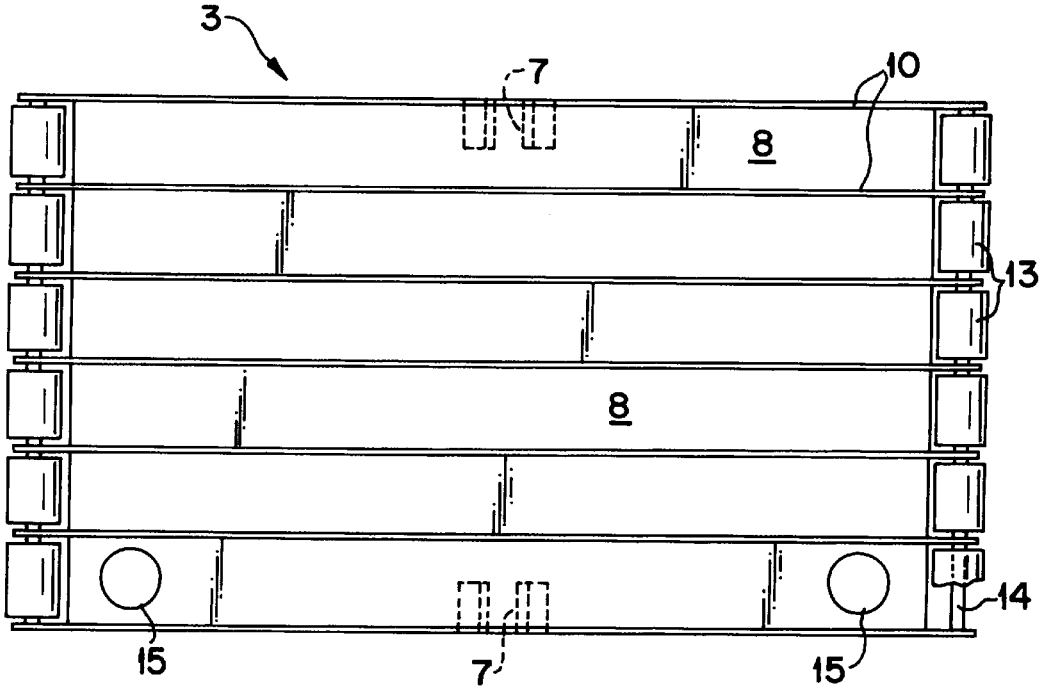

The diagrammatic side view of the frame 4 in FIG. 3 shows, in connection with FIG. 2, that a shaft-like element 6 is provided in the middle area of the frame 4 for mounting the base element 3. This is also clearly recognizable in the top view shown in FIG. 4. So that the base element 3 can be accordingly mounted inside the frame 4, the base element 3 has at least one recess 7 corresponding to the shaft-like element 6. The view in FIG. 7 shows, however, that the base element 3 shown here has two recesses 7 corresponding to the shaft-like element 6.

Figure 5:
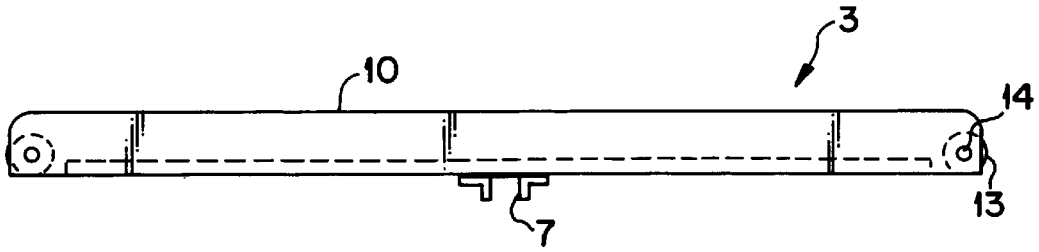

Although only two cleaning elements 2 are shown in FIG. 1 and no cleaning element 2 at all shown in FIGS. 5 though 7, several cleaning elements 2—not shown here—are provided. The cleaning elements 2 have an elongates shape. FIGS. 1, 1*a*, 6 and 7 show that the base element 3 has several slide-rail-like guides 8 to receive/mount the cleaning elements 2 (the cleaning elements 2 are not shown in FIGS. 6 and 7, however). In the case of the form of construction shown here, the aforementioned recesses 7 for receiving the shaft-like element 6 are formed by additional elements—not described in more detail—arranged below the base element 3. It is conceivable for the rail-like guides 8, in this case six rail-like guides 8, to be arranged one behind the other, whereby in each case the first and last rail-like guides 8 are arranged on a corresponding support rail. It is also conceivable for the base element 3 to have no support rails, but rather a base plate on whose upper surface the rail-like guides 8 can then be designed, whereby the aforementioned recesses 7 can then be provided in the support rails or the base plate.

Figure 6:
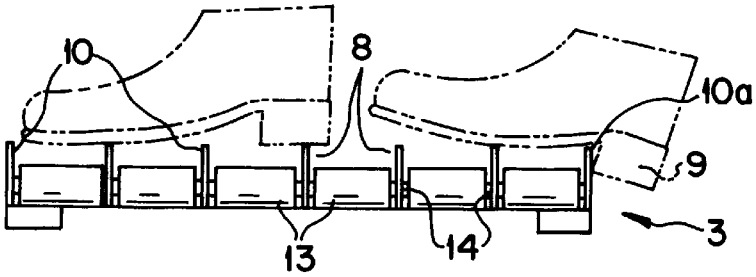
Figure 8:
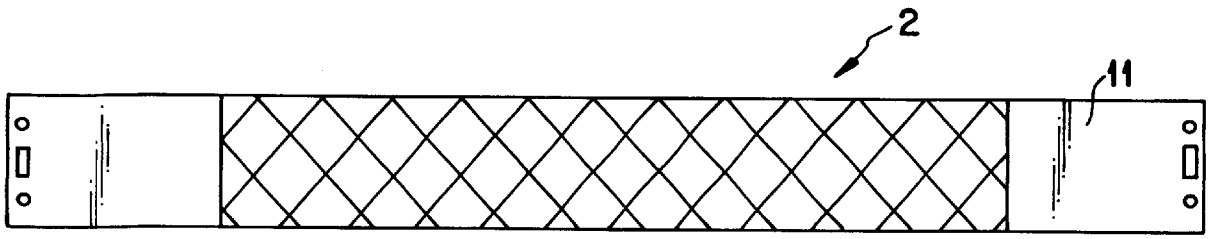
Figure 9:
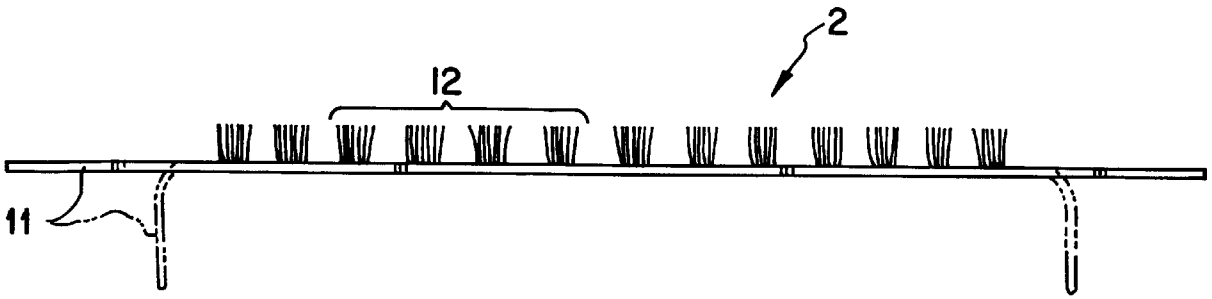

FIGS. 1 and 6 show the upper edges 10 of the rail-like guides 8, whereby in FIG. 5 the bottom of a rail-like guide 8 is shown in dashed line. Regarding FIG. 6, it can be seen that the shoe soles—not designated in more detail here—of the shoe shown in dashed line come to rest on the upper edges 10 of the rail-like guides 8. As FIG. 1 and FIGS. 8 and 9 show, the cleaning elements 2 are designed belt-like. The cleaning elements 2 are namely arranged on a belt 11 in this case. Any kind of arrangement of the cleaning elements 2 on the belt 11 is conceivable, whereby the cleaning elements 2 are preferable clamped on the belt 11. But glued joints also come into consideration for joining the cleaning elements 2 and the belts 11, whereby cleaning elements designed completely in one piece are also conceivable.

The view in FIG. 9, less diagrammatic than FIG. 8, shows that the cleaning elements 2 have bristles 12. In principle, the cleaning elements 2 can be made of any suitable material. However, the cleaning elements 2 are preferably made of plastic or an organic tissue, in such a way that in particular the bristles 12 can also be produced.

Although this is not shown in FIG. 6, because no cleaning elements 2 are shown here, from FIG. 1 in connection with the sole cleaning element 2 shown here, it can be seen that the cleaning element 12 is designed in such a way that in particular its bristles 12 protrude over the edges 10 of the rail-like guides 8. In this connection, more details are provided further below in the functional description of the device 1. In addition, FIG. 6 shows that the base element 3 is additionally designed accordingly for coarse dirt cleaning. FIG. 6 shows that at the outermost upper edge 10*a* of the base element 3, the heel 9 of the shoe shown on the right can be tilted for better cleaning of the shoe sole area adjacent to the heel 9. In particular, with a corresponding rocking motion, the shoe/heel 9 can be tilted far downward/ additionally brushed along.

The cleaning elements 2 / the belts 11 of the cleaning elements 2 have a certain length and are attached on the sides of the frame 4. To optimally ensure the relative motion between the shoe sole and the cleaning element 2, rollers 13 for the cleaning elements 2 designed belt-like are provided on the sides of the base element 3. Each roller 13 is mounted on an axle 14 at the end of a rail-like guide 8.

In particular FIG. 1 clearly shows that the device 1 for cleaning shoe soles shown here is designed as a kind of rocker. The user steps onto the base element 3, namely onto the upper edges 10 of the rail-like guides 8, in which the cleaning elements 2 are guided. The user walks on the base element 3 in such a way that, for example, his left shoe comes to rest to the left of the shaft-like element 6 on the base element 3 and his right shoe comes to rest to the right of the shaft-like element 6 on the base element 3. By a "rocking motion" carried out by the user, namely a swiveling of the base element 3 designed movably around its axis defined by the shaft-like element, the user can produce a relative motion between the cleaning elements 2 and the shoe soles sitting on the base element 3. If, looking at FIG. 1, the base element 3 tips left and downward, the cleaning elements 2 move to the right—relatively speaking. If the base element 3 of FIG. 1 tips to the right, the cleaning elements 2 move to the left—relatively speaking. Since the cleaning elements 2/the bristles 12 are designed in such a way that they protrude over the upper edges 10 of the rail-like guides 8, the cleaning elements 2/their bristles 12 brush over the shoe soles, whereby the users shoes, that is, the shoe soles can rest firmly on the upper edges 10 of the base element 3. In this connection it is advantageous that a cleaning of the shoe soles crosswise to their longitudinal direction, namely preferably in the direction of the profiled grooves, is ensured. A further advantage is that the cleaning effect is further improved when the user executes the rocking motions and in so doing, changes the upper edges 10, in such a way that the initial resting areas of the shoe soles can also be cleaned.

To ensure an optimal cleaning of the shoe soles, the cleaning elements 2 can be accordingly pressed downward when a corresponding shoe sole is rested on the base element 3, whereby the upper ends of the bristles come to rest directly ion the surface of the shoe sole, however. Furthermore, the attachment of the belt-like designed cleaning elements 2 to the sides of the frame 4 can likewise be designed elastic, which can be preferably realized by a rubber-like attachment to the sides of the frame 4. Due to the resulting flexibility, the cleaning elements 2 can be optimally guided into the rail-like guides 8, in such a way that the "rocking motion" to be carried out by the user is also easy to execute. But it can thus be seen from FIG. 9—shown in dashed line —that the belt 11 is designed easily deformable, partially "elastic", whereby it cannot be seen from this illustration that the cleaning element 2 is clamped onto the belt 11.

FIG. 7 shows only two openings 15, for example, provided in the area of the lowest rail-like guide 8. The opening 15 services to let loosened dirt particles through. Depending on the design of the rail-like guides 8, different sized openings 15 can be provided in various numbers. Due to the openings 15, the dirt detached from the shoe sole/the dirt particles separated from the shoe soles can be carried away, namely transferred into the frame 4. Since the frame 4 is designed as a trough, the frame 4 can be emptied/cleaned after a certain period of use and the depositing of a certain quantity of dirt particles.

Figure 10:
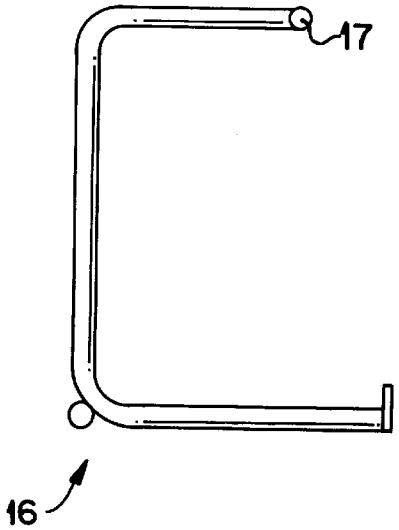
Figure 11:
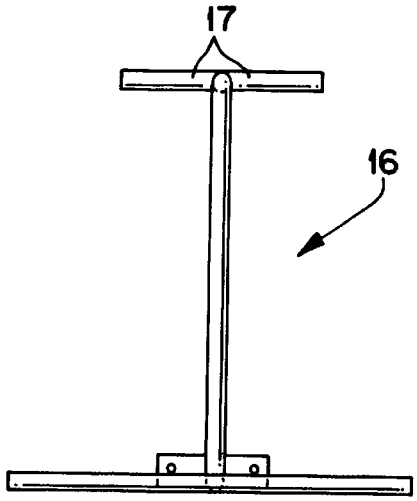
Figure 12:
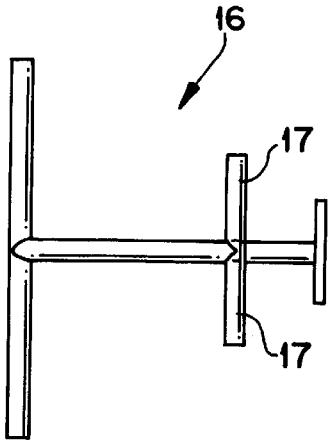

FIGS. 10 through 12 show the holding device 16—already indicated at the upper left edge which can be additionally provided. The holding device 16 shown here serves to support a user standing on the base element 3. The holding device 16 shown here can be attached to the frame and has at least one handle 17, preferably two handles 17 the user can hold onto while he uses the device 1, that is, while he carries out the "rocking motions" to clean the soles of his shoes.

With the device 1 shown in FIGS. 1 through 12, a new principle, i.e., method for cleaning shoe sole is produced. In this connection, the shoe sole is cleaned/cleansed by a relative motion carried out with direct effect between the shoe sole and a cleaning element. The shoe sole is placed on a base element 3, whereby the base element 3 is moved to create the relative motion between the shoe sole and the cleaning element 2.

It is altogether conceivable for a motorized drive have been or to be provided in order to carry out the "rocking motions" of the base element 3. Other additional componentry such as a switching system or sensors can also be provided to carry out the "rocking motions" of the base element 3.

What is claimed is:

1. A device for cleaning shoe soles comprising at lease one cleaning element and at least one base element as support for the shoe sole, whereby the shoe sole is cleaned by a relative motion carried out with direct effect between the shoe sole and the cleaning element, wherein the base element is movable, and whereby the shoe sole is placed stationary relative to an upper surface of said base element, and the relative motion between the shoe sole and the cleaning element is created by movement of the base element.

2. The device of claim 1 further comprising a frame, wherein the base element is mounted movably in said frame at a mid-region of the frame.

3. The device of claim 2, wherein the cleaning elements comprise belts having opposing ends, and wherein said opposing ends are attached to opposite ends of the frame.

4. The device of claim 3, wherein belt-like cleaning elements are at least elastic at the location of attachment to the frame.

5. The device of claim 2, wherein the frame comprises a receptacle with a raised outer edge.

6. The device of claim 2, further comprising at least one shaft element provided in the middle area of the frame for mounting the base element.

7. The device of claim 6, wherein the base element comprises at least one recess corresponding to the shaft element.

8. The device of claim 1, comprising several cleaning elements, wherein the cleaning elements have an elongated shape.

9. The device of claim 1, wherein the base element comprises several slide-rail guides to receive/mount the cleaning elements.

10. The device of claim 9, further comprising openings in said base near the rail-like guides to permit loosened dirt particles to pass downwardly through.

11. The device of claim 9, wherein the base element comprises two support rails or a base plate on whose upper edges or surfaces, respectively, the rail guides are arranged.

12. The device of claim 11, wherein the upper edges of the rail guides server as a support for the shoe sole(s) to be cleaned.

13. The device of claim 1, wherein at the outermost edge of the base element, a heel of a shoe of a user can be tilted for better cleaning of the shoe sole area adjacent to the heel.

14. The device of claim 1, wherein the cleaning elements are designed to be belt-like.

15. The device of claim 14, further comprising rollers provided on the sides of the base element for providing a relative motion between said shoe and said belt-like cleaning elements.

16.The device of claim 15, wherein each roller is mounted on an axle at an end of a rail guide of said base element.

17. The device of claim 14, wherein the cleaning elements at least partially elastic.

18. The device of claim 1, wherein the cleaning elements are arranged on a belt.

19. The device of claim 1, wherein the cleaning elements are affixed on a belt.

20. The device of claim 1, wherein the cleaning elements comprise bristles.

21. The device of claim 1, wherein the cleaning elements are made of plastic or natural material.

22. The device of claim 1, wherein the device operates with a rocking motion.

23. The device of claim 1, wherein said device cleans the shoe soles crosswise to their longitudinal direction with the cleaning elements.

24. The device of claim 1, further comprising a holding device for supporting a user standing on the base element.

25. A method of cleaning shoe soles with the device of claim 1, comprising placing a shoe sole downwardly onto the base element, moving the base element to create a relative motion between the shoe sole and the cleaning element and cleaning the shoe sole by said relative motion carried out with a direct effect between the shoe sole and the cleaning element, wherein said sole remains stationary relative to an upper surface of said base element.

26. The method of claim 25, wherein the base element is moved in a rocker-like manner.

27. A device for cleaning a shoe sole(s) comprising:

at least one cleaning element; and at least one base element as support for the shoe sole, wherein said base element is movable, said movement of said base element causing a relative movement between said shoe sole and said cleaning element, and whereby when said shoe sole remains stationary relative to said base element, a friction is created between said shoe sole and said cleaning element that causes the cleaning of said shoe sole.

* * * * *